US010731344B2

(12) United States Patent
Stockfelt

(10) Patent No.: US 10,731,344 B2
(45) Date of Patent: Aug. 4, 2020

(54) SANDWICH CONSTRUCTION ELEMENT WITH AN OPEN CORE STRUCTURE COMPOSED OF CLOSE PACKED TETRAHEDRA

(71) Applicant: NITIU AB, Gävle (SE)

(72) Inventor: Michail Stockfelt, Gävle (SE)

(73) Assignee: NITIU AB, Gävle (SE)

( * ) Notice: Subject to any disclaimer, the term of this patent is extended or adjusted under 35 U.S.C. 154(b) by 0 days.

(21) Appl. No.: 16/074,814

(22) PCT Filed: Feb. 6, 2017

(86) PCT No.: PCT/SE2017/050106

§ 371 (c)(1),
(2) Date: Aug. 2, 2018

(87) PCT Pub. No.: WO2017/138864

PCT Pub. Date: Aug. 17, 2017

(65) Prior Publication Data

US 2019/0040631 A1 Feb. 7, 2019

(30) Foreign Application Priority Data

Feb. 8, 2016 (SE) ..... 1650152

(51) Int. Cl.
*E04C 3/07* (2006.01)
*E04C 3/00* (2006.01)
(Continued)

(52) U.S. Cl.
CPC ..... *E04C 3/07* (2013.01); *B21C 23/145* (2013.01); *B21D 47/01* (2013.01); *B63B 3/68* (2013.01);
(Continued)

(58) Field of Classification Search
CPC ... E04C 3/07; E04C 3/005; E04C 3/09; E04C 2003/0413; E04C 2003/0465; E04C 2/34; E04B 1/19; B21C 23/145; B21D 47/01
See application file for complete search history.

(56) References Cited

U.S. PATENT DOCUMENTS 3,237,362 A * 3/1966 Fromson ..... E04C 2/34 428/166
3,296,767 A * 1/1967 Lebowitz ..... E04B 1/19 52/634
(Continued)

FOREIGN PATENT DOCUMENTS

RU 68 542 U1 11/2007
WO WO 02/10535 2/2002
WO WO 2011/025268 3/2011

OTHER PUBLICATIONS

International Search Report for corresponding Patent Application No. PCT/SE2017/050106 dated Apr. 7, 2017.
(Continued)

*Primary Examiner* — Brian D Mattei
(74) *Attorney, Agent, or Firm* — Renner, Otto, Boisselle & Sklar, LLP

(57) ABSTRACT

A sandwich construction element (100) is disclosed. The sandwich construction element comprises a first element (101) with a face, extending in a longitudinal direction with a thickness and a height being smaller than the longitudinal length, and a second element (102) with a face, extending in the same longitudinal direction as the first element with a thickness and a height being smaller than the longitudinal length, wherein the second element is facing the flat face of the first element (101). The sandwich construction element further comprises an open core structure (103) arranged between, and operatively connected to the first element (101) and the second element (102), wherein the open core
(Continued)

structure comprises a plurality of close packed tetraeder structures (201).

18 Claims, 3 Drawing Sheets

(51) Int. Cl.

| | |
|---|---|
| ***B63B 3/68*** | (2006.01) |
| ***B21C 23/14*** | (2006.01) |
| ***B21D 47/01*** | (2006.01) |
| ***E04C 3/09*** | (2006.01) |
| ***E04C 3/04*** | (2006.01) |

(52) U.S. Cl.
CPC ..... *E04C 3/005* (2013.01); *E04C 3/09* (2013.01); *B63B 2241/16* (2013.01); *E04C 2003/0413* (2013.01); *E04C 2003/0465* (2013.01)

(56) References Cited

U.S. PATENT DOCUMENTS

| | | | | |
|---|---|---|---|---|
| 3,831,503 | A | 8/1974 | Tranquillitsky | |
| 3,849,237 | A * | 11/1974 | Zetlin | E01D 1/00 14/73 |
| 4,020,205 | A * | 4/1977 | Haselbauer | B32B 3/12 428/116 |
| 4,967,533 | A | 11/1990 | Weisse | |
| 5,070,673 | A * | 12/1991 | Weisse | B29C 33/42 428/116 |
| 8,745,958 | B2 | 6/2014 | Kang et al. | |
| 2005/0115186 | A1 | 6/2005 | Jensen et al. | |
| 2010/0323181 | A1 | 12/2010 | Nutt et al. | |
| 2012/0159895 | A1 | 6/2012 | Kawecki | |

OTHER PUBLICATIONS

Supplementary European Search Report for corresponding European Patent Application No. 17 75 0517 dated Sep. 11, 2019.

Russian Office Action and translation for corresponding Russian Patent Application No. 2018131585/03 dated Apr. 9, 2020.

Russian Search Report for corresponding Russian Patent Application No. 2018131585/03 dated Apr. 6, 2020.

* cited by examiner

SANDWICH CONSTRUCTION ELEMENT WITH AN OPEN CORE STRUCTURE COMPOSED OF CLOSE PACKED TETRAHEDRA

This application is a national phase of International Application No. PCT/SE2017/050106 filed Feb. 6, 2017 and published in the English language, which claims priority to Swedish Patent Application No. 1650152-0 filed Feb. 8, 2016, which are hereby incorporated herein by reference.

TECHNICAL FIELD

The present invention relates to a sandwich construction element, and more particularly to a sandwich construction element with an open core.

BACKGROUND OF THE INVENTION

A problem during design of for example a ship, encountered today is that if for example a hull of a ship is manufactured with modern alloys and design, the hull becomes lightweight and strong. But the deck and the various vertical and horizontal walls used in the construction of a ship becomes heavy weight if standard design is used. Therefore, a need for lightweight and sturdy panels of various dimensions and areas exists.

A promising design for such panels is disclosed in U.S. Pat. No. 8,650,756 B2 which provides a solution that involves either extrusion of panels or additive/subtractive manufacturing. If extrusion is used the available materials for construction is rather limited and a lightweight alloy, such as an alumina alloy would be the most likely candidate. However, if the hull of the ship is manufactured in stainless-steel there is a problem related to joining alumina alloys and stainless steel. There exists an alternative to manufacture panels using additive/subtractive manufacturing, but this alternative is rather expensive if large panels are desired.

Furthermore, the truss design used in U.S. Pat. No. 8,650,756 B2 is rather weak and leaves room for improvement. One of its advantages is that the core of the sandwich material may be formed by bending a metal net to a pyramidal lattice. It is well known in solid mechanics that this truss structure is far from optimal from a structural strength point of view, for example if one of the base corners of the pyramidal lattice is subjected to momentum.

It is an object of the present invention to provide a solution that is compatible with modern ship design that involves lightweight hulls.

It is another object of the present invention to provide a more robust and sturdy sandwich construction that simultaneously provides very low density.

It is another object of the present invention to provide a sandwich construction that provides excellent resistance against corrosive agents or environments.

SUMMARY OF THE INVENTION

According to the present invention, the above mentioned objects and other advantages are obtained by providing a sandwich construction element according to the independent claim.

In one aspect, the present invention provides a sandwich construction element. The sandwich construction element comprises a first element with a face, extending in a longitudinal direction with a thickness and a height being smaller than the longitudinal length. The sandwich construction element further comprises a second element with a face, extending in the same longitudinal direction as the first element with a thickness and a height being smaller than the longitudinal length, wherein the second element is facing the flat face of the first element. The sandwich construction element further comprises an open core structure arranged between, and operatively connected to the first element and the second element.

The sandwich construction element is characterized in, that the open core structure comprises a plurality of close packed tetrahedron structures.

The terms "flat", "close packed", and "unit cell" as used herein are to be interpreted in a broad sense. The term "flat" should be interpreted as essentially flat. The term "close packed" should be interpreted as fully packed, unit cell should be interpreted as an element used to close pack a volume i.e. to completely fill the volume with unit cells.

In one embodiment of the sandwich construction element, the open core structure comprises at least two flat elements arranged between the first element and the second element, wherein the at least two flat elements are arranged between the faces of the first element and the second element, and facing each other with a first distance between the two elements.

In one embodiment of the sandwich construction element, the open core structure comprises a plurality of unit cells arranged between two of the at least two flat elements, wherein each unit cell comprises two flat parallelogram arranged in an overlapping intersecting relation along a diagonal of the two flat parallelogram, with an angle between the two flat parallelogram.

In one embodiment, wherein each of the parallelogram comprises a slit along the diagonal of the parallelogram from a corner to at least the center of the parallelogram, wherein the slit is configured to receive a corresponding parallelogram with a slit such that the two parallelograms are joined along the diagonal of each parallelogram. In this way, a strong and flexible joint between the first parallelogram and the second parallelogram may be obtained.

In one embodiment, each of the parallelograms of the unit cell comprises a recesses arranged at a distance from the diagonal. This way allows an open connection between the pluralities of unit cells. Furthermore, this allows the unit cell to be dimensioned for a specific load without unnecessary mass.

In one embodiment, the diagonal is the shortest diagonal of the two flat parallelograms. This way, a preferred unit cell is obtained.

In one embodiment, the face of the first element, and the face of the second element are flat. This way, a symmetrical construction element is obtained.

In one embodiment, the plurality of unit cells are formed by two flat arrays, wherein each flat array comprises a repeating triangular wave pattern formed by a first parallelogram having a first edge operatively connected to an edge of an intermediate parallelogram. In this way, an efficient way of manufacturing the unit cells are obtained.

In one embodiment, the sandwich construction comprises sheet metal, and in a preferred embodiment the sheet metal is made of stainless steel. In this way, the sandwich structure may resist corrosive agents and environments simultaneously as the sandwich construction is lightweight and provides excellent structural strength.

A more complete understanding of the invention, as well as further features and advantageous thereof, will be obtained by reference to the following detailed description and drawings.

DETAILED DESCRIPTION OF THE INVENTION

The following description is for illustration and exemplification of the invention only and is not intended to limit the invention to the specific embodiments described.

All references cited herein, including patents and patent applications are incorporated by reference in their entirety.

Unless defined otherwise, technical and scientific terms have the same meaning as commonly understood by one of ordinary skill in the art to which this invention belongs.

The meaning of the terms "flat", "close packed" and "unit cell" as used herein are as follows.

The term "flat" should be interpreted as essentially flat.

The term "close packed" means that a volume is completely filled with a basic construction in a symmetric and repetitive way.

The "unit cell" is the basic geometry used for close packing of a volume.

Figure 1:
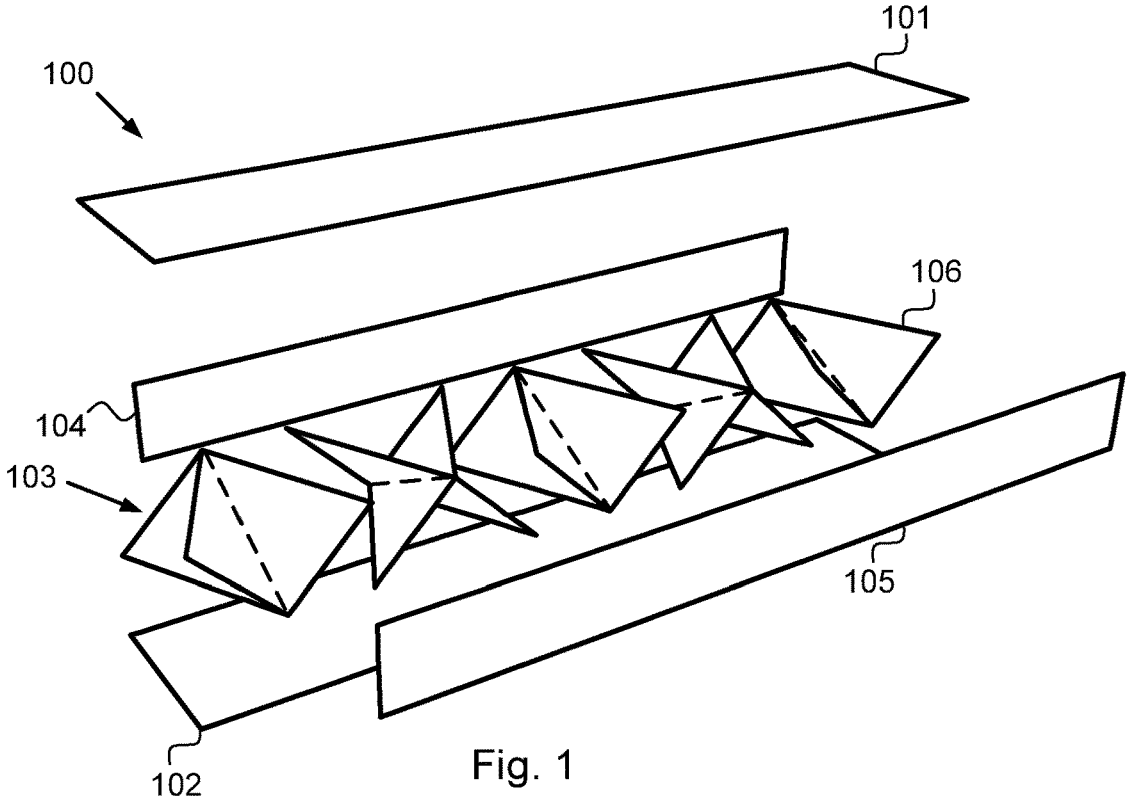
FIG. 1 is an exploded schematic perspective view of an embodiment of a sandwich structure according to the present invention.

FIG. 1 shows an exploded perspective view of a sandwich construction element, generally designated 100, according to a first embodiment of the present invention. The sandwich construction element 100 comprises a first element 101 with a flat face and a second element 102 with a flat face being parallel and facing the flat face of the first element 101. The sandwich construction element further comprises an open core structure 103 arranged between the first element 101 and the second element 102. The open core structure 103 is operatively connected to the first element 101 and the second element 102.

The open core structure 103 comprises a plurality of close packed tetrahedrons structures 201.

Furthermore, the open core structure comprises at least two flat elements 104, 105 arranged between the first element 101 and the second element 101. The at least two flat elements 104, 105 are arranged perpendicular to the flat faces of the first element 101 and the second element 102, and facing each other with a first distance between the two flat elements 104, 105.

The two flat elements 104, 105 and the first element 101 and the second element 102 define a box shaped volume. This volume is filled with unit cells 106 in a repetitive pattern as shown exploded in FIG. 1.

Figure 2:
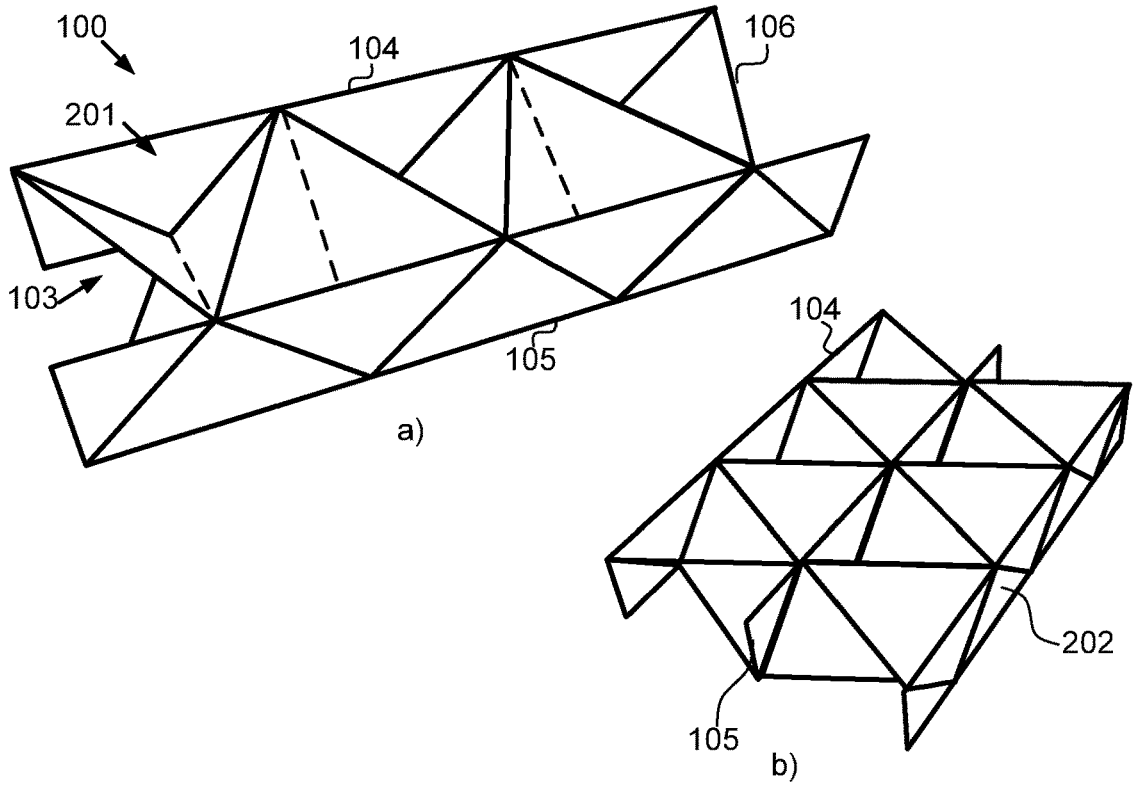
FIG. 2 is a schematic perspective view of an embodiment sandwich construction according to the present invention.

In FIG. 2*a* the sandwich construction element 100 is shown with the unit cells 106 packed together. In this FIG. 2*a* it is shown that by packing the unit cells together the box shaped volume is close packed filled with tetrahedron structures 201. In this figure the first element 101 and the second element 102 are not shown since they would obstruct the perspective view of the tetrahedron structures 201. In FIG. 2*b* an additional flat element 202 is added to the at least two flat elements 104, 105 at a distance equal to the first distance, and the volume defined by the flat elements 105, 202 is close packed with tetrahedron structures. By adding more flat elements and unit cells panels of arbitrary sizes can be formed in a repetitive pattern.

Figure 3:
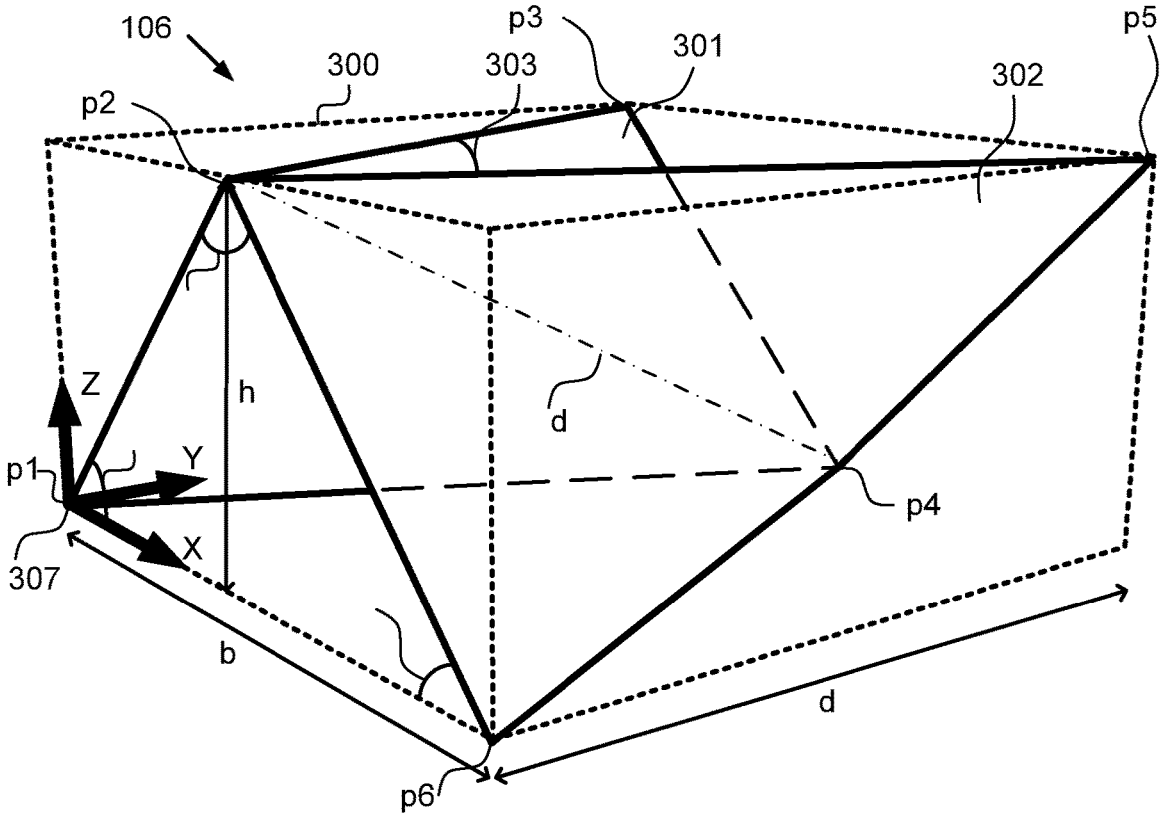
FIG. 3 is a schematic perspective view of a unit cell according to the present invention.

In FIG. 3 the unit cell 106 is shown in a perspective view with an added imaginary dotted box 300 as a help structure. The dotted box 300 has a width of b, a depth of d and a height of h in arbitrary units. In a first corner 307 is a coordinate system defined with an X axis along the base line of the width direction of the box 300, a Y axis extends along the baseline of the depth direction of the box 300, and a Z axis extends along the baseline of the height direction of the box 300. In order to define the unit cell 106 six points are needed. These six points are as follows p1=[0,0,0], p2=[b/2,0,h], p3=[0,d,h], p4=[b/2,d,0], p5=[b,d,h], and p6=[b,0,0], where [x coordinate, y coordinate, z coordinate].

As can be seen from FIG. 3, the six points in the unit cell, defined above, define two tetrahedrons sharing a diagonal spine. The tetrahedrons may have an XZ plane that is perpendicular to the XY plane and are thus asymmetric tetrahedrons.

FIG. 3 shows that a first parallelogram 301 is formed by point's p2, p3, p4 and p6. A second parallelogram 302 is formed by p1, p2, p5, and p4. These two flat parallelograms 301, 302 are arranged in an overlapping intersecting relation along a diagonal d between point's p2 and p4, with an angle 303 between the two flat parallelograms 301, 302. From this figure a triangle is identified in the XZ-plane between point's p1, p2 and p6 and from a solid mechanics point of view this triangle is most preferably an equilateral triangle.

In a unit cell according to the present disclosure, a volume is formed between the tetrahedrons, which is asymmetric and have two of the planes perpendicular. This has the advantage that a pattern with unit cells that alternate orientation can create a rectangular parallelepiped. I.e. a volume with parallel sides which is good or advantageous, e.g. for generating sheets, plates, columns and beam profiles. This is in contrast to a unit cell based on symmetric tetrahedrons. A symmetric tetrahedron is defined as having four equilateral triangle faces, where every in-plane angle is 60° and every edge is of equal length. Symmetric tetrahedrons cannot easily be assembled in a pattern that gives flat, parallel sides. Now with reference made to FIG. 4*a-c* different embodiments of the parallelograms 301, 302 will be discussed.

Figure 4:
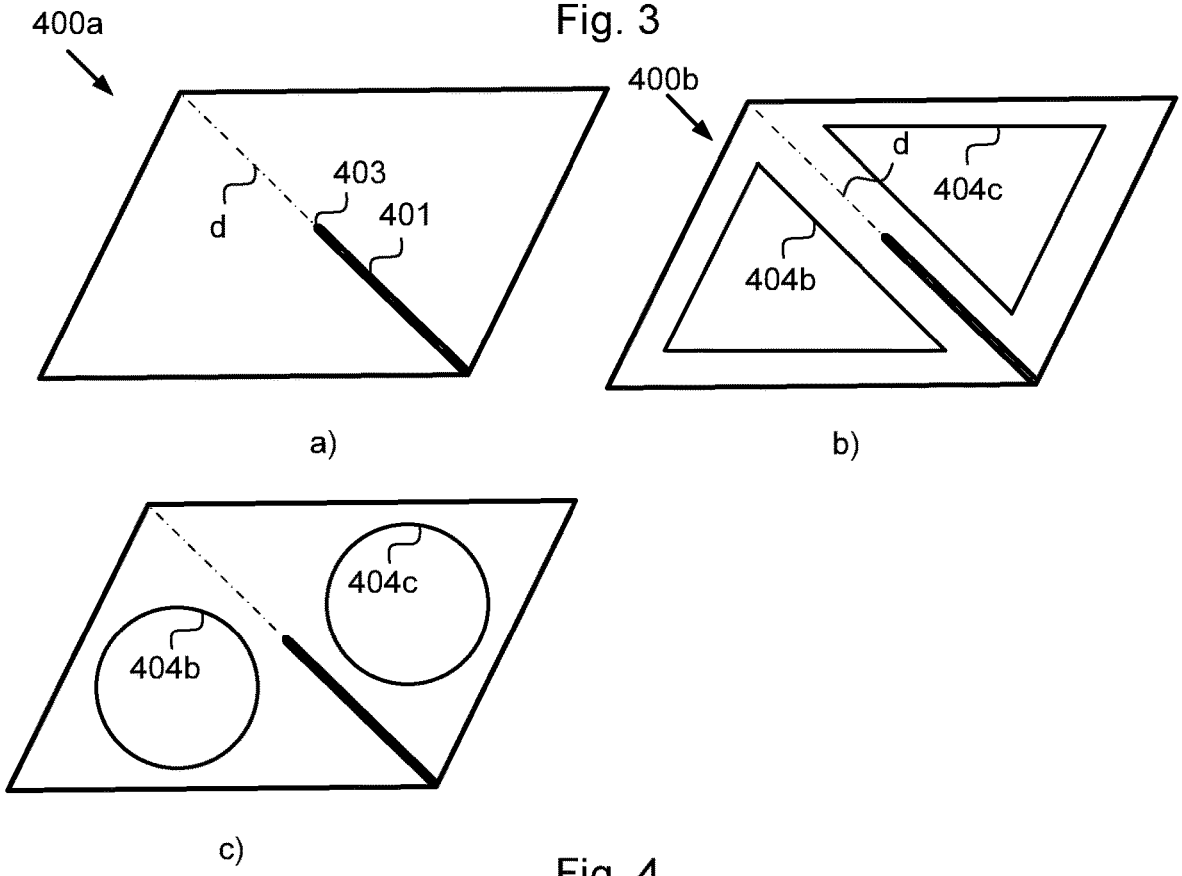
FIG. 4 is a schematic plan view of parallelograms according to the present invention.

In FIG. 4*a* a first embodiment of a parallelogram 400*a* is disclosed. The parallelogram 400*a* comprises a slit 401 along the diagonal d of the parallelogram from a corner to at least the center 403 of the parallelogram.

The slit 401 is configured to receive a corresponding parallelogram 400*a* with a slit 401 such that the two parallelograms are joined along the diagonal of each parallelogram, such that the end portions of the slit of the two parallelograms overlaps.

The parallelogram is also asymmetric as two of the sides are longer than the other two, thereby forming a tilted rectangle. When two such parallelograms are joined, e.g. by bringing one into the other via the slits, they create a cross that shape or form the diagonal back of two tetrahedrons.

In FIG. 4*b*, a second embodiment of a parallelogram 400*b* is disclosed. This parallelogram 400*b* comprises recesses 404*b* arranged at distance from the diagonal d.

In this particular embodiment the recesses are triangles but other shapes are of course possible such as holes 404*b* and 404*c* as disclosed in FIG. 4*c*.

The purpose of the recesses may be to provide a more lightweight structure, or for allowing fluid communication between the unit cells. In one embodiment the at least two flat elements comprises recesses for the same purposes.

Figure 5:
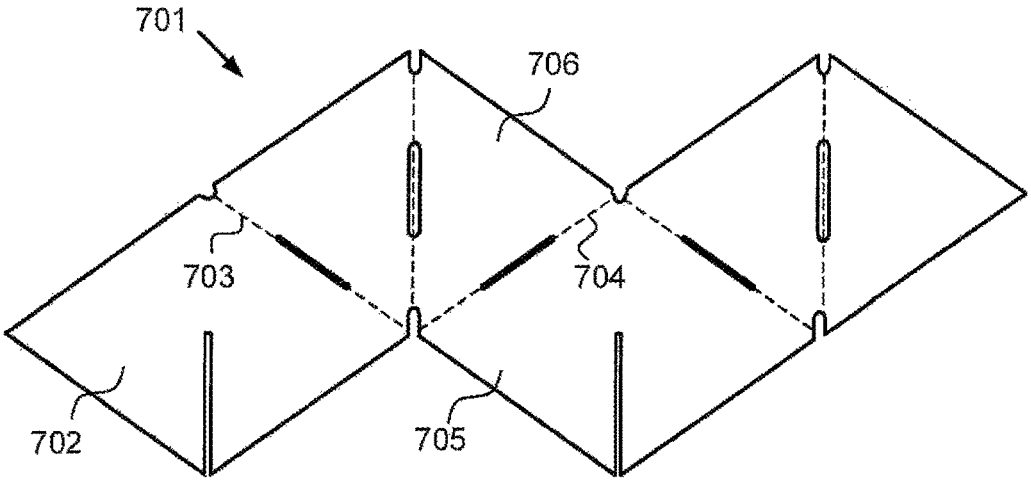
FIG. 5 is a planar view of an embodiment of a flat array according to the present invention.

The parallelogram may also comprise tabs along the sides of the parallelogram facing the at least two flat elements, wherein the flat elements comprises corresponding recesses. In this way, the unit cells may be operatively connected to the at least two flat elements. In one embodiment the unit cells are operatively connected to the first and the second element, with for example a welded joint or an adhesive. FIG. 5 discloses a flat array 701 of parallelograms 702, 705 with intermediate parallelograms 706. This flat array 701 forms a repeating triangular wave pattern by a first parallelogram 702 having a first edge 703 operatively connected to an edge of an intermediate parallelogram 706.

In one embodiment, the flat array may comprise folding lines along the common edges 703,704 between adjacent first parallelogram and intermediate parallelogram, wherein the intermediate parallelogram comprises a folding line along its short diagonal.

By bending the parallelograms of a first flat array and a second flat array, along the edges 703 in a first angle and the intermediate parallelograms along the short diagonals in a second angle, a bended array that can be used to obtain an array of unit cells is formed.

Figure 6:
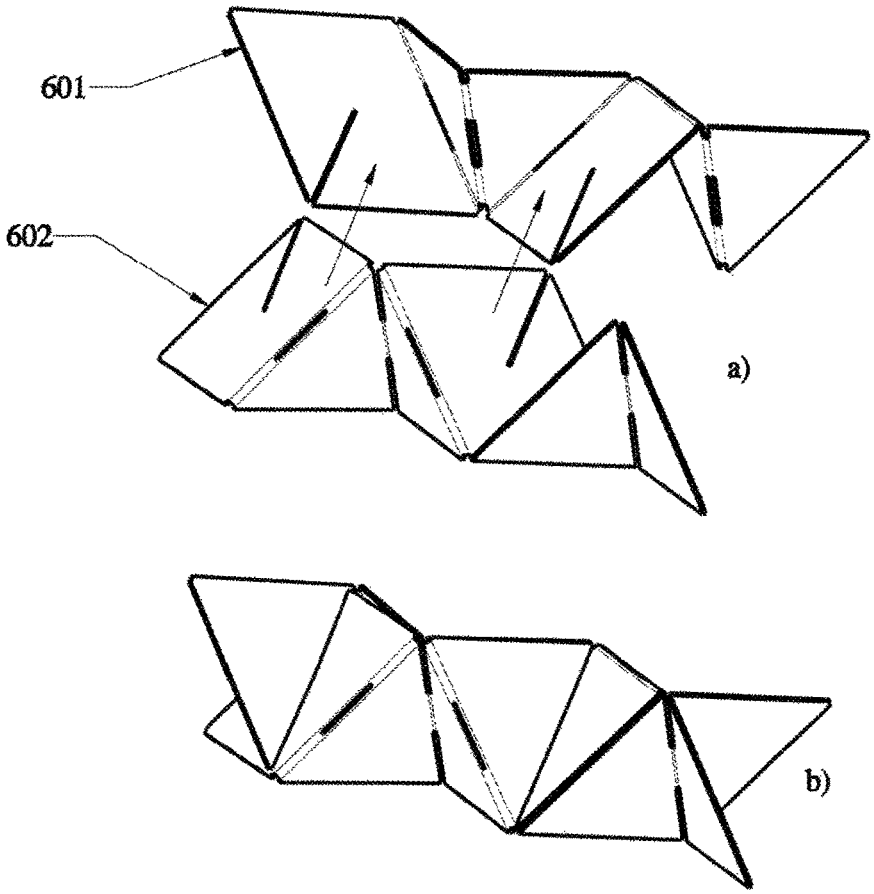
FIG. 6 is a schematic perspective view of an embodiment of a flat array according to the present invention.

In FIG. 6*a* is a bended first array 601 arranged opposite a bended second array 602, with corresponding recesses aligned to each other. By joining theses arrays 601, 602 an array of unit cells are formed. This has the effect that a large number of unit cells may be efficiently manufactured.

In one embodiment, the sandwich construction element comprises sheet metal. And in a preferred embodiment the sheet metal is stainless steel. This way the sandwich construction element may be efficiently integrated with a modern hull of a ship.

In one embodiment of the sandwich construction, the unit cells of the open cell core is operatively connected to the at least two flat elements by means of tabs extending from the unit cells into corresponding grooves in the at least two flat elements.

In one embodiment of the sandwich construction element the unit cells of the open cell core is operatively connected to the first element and the second element by means of an adhesive.

In one embodiment of the sandwich construction element the unit cells of the open cell core is operatively connected to the first element and the second element by means of welding.

The present invention is not limited to the above-described preferred embodiments. Various alternatives, modifications and equivalents may be used. Therefore, the above embodiments should not be taken as limiting the scope of the invention, which is defined by the appending claims.

The invention claimed is:

1. A sandwich construction element, comprising:

a first element with a face, extending in a longitudinal direction with a thickness and a height being smaller than the longitudinal length;

a second element with a face, extending in the same longitudinal direction as the first element with a thickness and a height being smaller than the longitudinal length, wherein the second element is facing the face of the first element; and an open core structure arranged between, and operatively connected to the first element and the second element, wherein the open core structure comprises a plurality of close packed tetrahedron structures, wherein the tetrahedron structures are asymmetric and are arranged to form one or more unit cells defining a box shaped volume, the box shaped volume having perpendicular sides;

wherein the plurality of close packed tetrahedron structures include interior asymmetric tetrahedral structures, each side of which is in the shape of a non-equilateral triangle;

wherein the planar extent of each side of each interior asymmetric tetrahedral structure extends at an oblique angle relative to the planar extents of the first and second elements;

wherein each unit cell includes two parallelograms arranged in overlapping intersecting relation along a diagonal of the two parallelograms, with an angle between the two parallelograms;

wherein each of the parallelograms has a slit along the diagonal of the parallelogram extending inwardly from a corner of the parallelogram; and wherein the slit receives a corresponding parallelogram with a slit such that the two parallelograms are joined along the diagonal of each parallelogram.

2. The sandwich construction element according to claim 1, wherein the open core structure comprises at least two flat elements arranged between the first element and the second element, wherein the at least two flat elements are arranged between the faces of the first element and the second element, and facing each other with a first distance between the two elements.

3. The sandwich construction element according to claim 2, wherein the plurality of unit cells are arranged between two of the at least two flat elements.

4. The sandwich construction element according to claim 3, wherein each of the parallelograms is flat.

5. The sandwich construction element according to claim 2, wherein the parallelograms of the unit cells comprise recesses arranged at a distance from the diagonal.

6. The sandwich construction element according to claim 1, wherein the diagonal is the shortest diagonal of the two flat parallelograms.

7. The sandwich construction element according to claim 1, wherein the face of the first element, and the face of the second element are flat.

8. The sandwich construction element according to claim 7, wherein the at least two flat elements are arranged perpendicular to the flat faces of the first element and the second element.

9. The sandwich construction element according to claim 1, wherein the plurality of unit cells are formed by two arrays, wherein each array comprises a repeating triangular wave pattern formed by a first parallelogram having a first edge operatively connected to an edge of an intermediate parallelogram.

10. The sandwich construction element according to claim 9, wherein the two arrays each have folding lines along common edges between the adjacent first parallelogram and intermediate parallelogram, and wherein the intermediate parallelogram has a folding line along its short diagonal.

11. The sandwich construction element according to claim 1, wherein the sandwich construction comprises sheet metal.

12. The sandwich construction element according to claim 11, wherein the sheet metal is stainless steel.

13. The sandwich construction element according to claim 1, wherein the unit cells of the open cell core are connected to the first and second elements by tabs extending from the unit cells into corresponding grooves in the first and second elements.

14. The sandwich construction element according to claim 1, wherein the unit cells are connected to the first element and the second element by an adhesive.

15. The sandwich construction element according to claim 1, wherein the unit cells are connected to the first element and the second element by welding.

16. The sandwich construction element according to claim 1, wherein each side of each interior asymmetric tetrahedral structures is formed by a corresponding portion of a flat parallelogram, the portion being in the shape of a non-equilateral triangle, and wherein the planar extent of the flat parallelogram extends at an oblique angle relative to the first and second elements.

17. A sandwich construction element, comprising:

a first element with a face, extending in a longitudinal direction with a thickness and a height being smaller than the longitudinal length;

a second element with a face, extending in the same longitudinal direction as the first element with a thickness and a height being smaller than the longitudinal length, wherein the second element is facing the face of the first element; and an open core structure arranged between, and operatively connected to the first element and the second element, wherein the open core structure comprises a plurality of close packed tetrahedron structures, wherein the tetrahedron structures are asymmetric and are arranged to form one or more unit cells defining a box shaped volume, the box shaped volume having perpendicular sides;

wherein the open core structure comprises at least two flat elements arranged between the first element and the second element, wherein the at least two flat elements are arranged between the faces of the first element and the second element, and facing each other with a first distance between the two elements;

wherein the one or more unit cells are arranged between two of the at least two flat elements;

wherein each unit cell comprises two parallelograms arranged in an overlapping intersecting relation along a diagonal of the two parallelograms, with an angle between the two parallelograms;

wherein each of the parallelograms comprises a slit along the diagonal of the parallelogram extending inwardly from a corner of the parallelogram to at least the center of the parallelogram; and wherein the slit receives a corresponding parallelogram with a slit such that the two parallelograms are joined along the diagonal of each parallelogram.

18. The sandwich construction of claim 17, wherein each of the parallelograms is flat.

* * * * *